United States Patent [19]

Workman

[11] 4,013,854

[45] Mar. 22, 1977

[54] COAXIAL SWITCH

[76] Inventor: Lester J. Workman, P.O. Box 5547, Sarasota, Fla. 33579

[22] Filed: Apr. 14, 1975

[21] Appl. No.: 567,764

[52] U.S. Cl. ..... 200/153 S

[51] Int. Cl.[2] ..... H01H 33/66

[58] Field of Search ..... 200/153 S, 153 R, 6 C, 200/6 BB, 11 TC

[56] References Cited

UNITED STATES PATENTS 3,588,410 6/1971 Guraydin ..... 200/153 S

FOREIGN PATENTS OR APPLICATIONS 646,510 11/1950 United Kingdom ..... 200/153 S

*Primary Examiner*—Herman J. Hohauser
*Attorney, Agent, or Firm*—Cushman, Darby & Cushman

[57] ABSTRACT

A coaxial switch including a switch body having a metallic walled recess therein and including one input (or output) coaxial line connection communicating with the recess and a plurality of output (or input) coaxial line connections also communicating with the recess. A switch operator including a connecting pin electrically coupled to the input coaxial connector is adapted to be switched between a plurality of positions with the connecting pin engaging one of the output coaxial connections at each position of the switch operator. At least one shielding member is provided which is mechanically operatively coupled to the switch operator and is moved by the switch operator to a position immediately adjacent and covering all of the output coaxial connections other than the one engaged by the connecting pin of the switch operator. Such a construction shields unused coaxial connections and prevents crosstalk.

8 Claims, 11 Drawing Figures

COAXIAL SWITCH

BACKGROUND OF THE INVENTION

This invention pertains to a coaxial switch and more particularly pertains to a coaxial switch especially suited for switching high frequency signals.

Switches intended for use in switching coaxial lines which are intended for carrying high frequency signals have special requirements. One important consideration is to secure the maximum amount of isolation possible between the various switching connections. That is, if an input can be switched between, say, two outputs it is desirable to secure the maximum amount of isolation possible between the input and the output which is not selected by the switch.

The prior art contains various examples of coaxial switches. Typically the prior art coaxial switches comprise an outer housing having a rotor cavity with a precisely machined switch rotor mounted therein. Such a construction, for example is shown in U.S. Pat. No. 2,938,984 and U.S. Pat. No. 3,141,943. Conductors are typically provided in the rotor and movement of the rotor, either by rotation or reciprocation thereof serves to connect and/or disconnect certain coaxial connectors with one another. The complexity of such prior art coaxial switches has caused them to be expensive; additionally, such prior art switches have been found not to provide sufficient isolation between outputs for switching high frequency signals on the order of 100 MHz or greater as is in common use today.

OBJECTS AND SUMMARY OF THE INVENTION

Accordingly, it is an object of this invention to provide a coaxial switch of simple construction and which provides a high degree of isolation between connections to the switch.

It is another object of this invention to provide a coaxial switch wherein a positive connection is made to a selected coaxial connector and all other unused coaxial connectors are positively shielded.

Briefly, in accordance with one embodiment of the invention, a coaxial switch is provided which includes a switch body having a metallic walled recess. An input (or output) coaxial line connection is provided communicating with the recess and a plurality of output (or input) connections also communicate with the recess. A switch operator is provided which includes at least one connecting pin for making positive engagement in a central conductor of any of the output coaxial line connections. The connecting pin is electrically coupled to the input coaxial line connection. The switch operator is movable between a plurality of positions such that the connecting pin engages a different one of the output coaxial line connections for each position of the switch operator. The switch operator is also mechanically coupled to a conducting shielding member. Movement of the switch operator moves the shielding member so that the shielding member for each position of the switch operator is positioned immediately adjacent to and covering the unused or unselected coaxial line connections to provide a high degree of isolation and prevent crosstalk.

DESCRIPTION OF THE PREFERRED EMBODIMENTS

Figure 1:
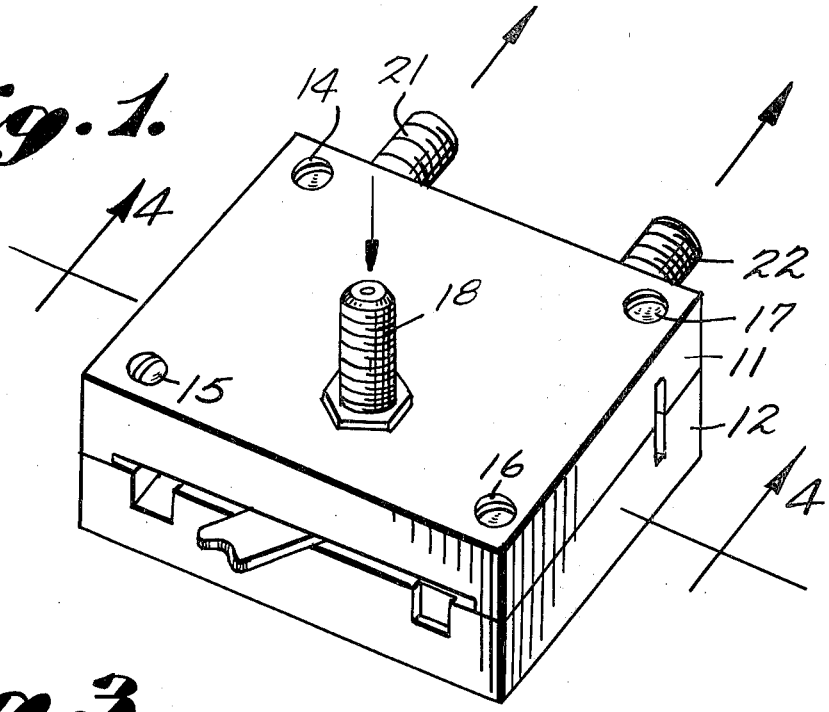
FIG. 1 is an isometric view of the exterior of a coaxial switch construction in accordance with one embodiment of the invention.
Figure 3:
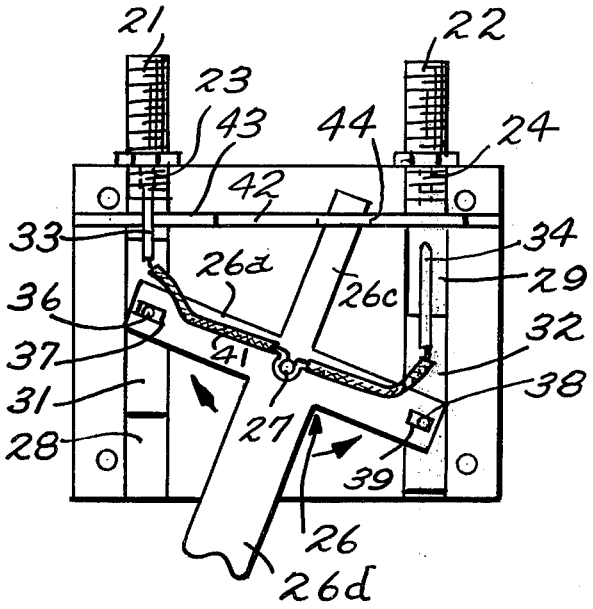
FIG. 3 is a top view of the switch construction of FIG. 1 with the top portion of the switch body removed.
Figure 2:
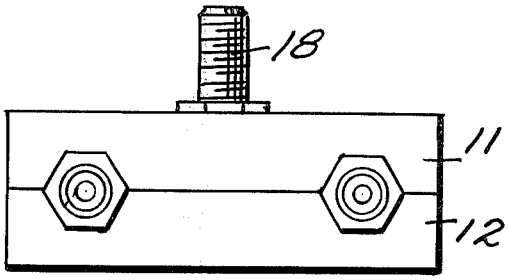
FIG. 2 is a side elevation of the switch of FIG. 1.
Figure 4:
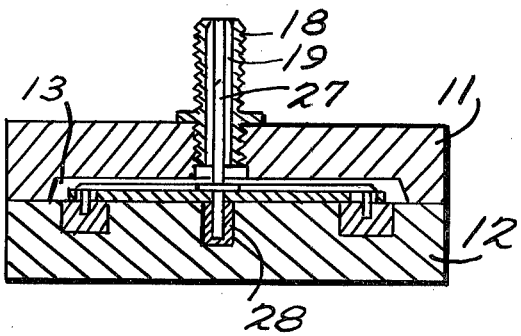
FIG. 4 is a sectional view of the switch construction of FIG. 1 taken along the lines 4—4 thereof.

Turning now to the drawings, there is shown in FIGS. 1 through 4 a coaxial switch construction in accordance with one embodiment of the invention. The coaxial switch of FIGS. 1 through 4 includes a switch body formed of top and bottom portions 11 and 12. The top and bottom portions 11 and 12 are configured so as to form a metallic walled recess therebetween generally indicated by reference numeral 13. The top and bottom portions of the switch body are suitably fastened together by means such as screws 14 through 17. An input coaxial connection 18 including a central conductor 19 is suitably secured (such as by threadably engaging) to one portion of the switch body, being particularly shown in FIG. 1 as being secured to the top portion 11 of the switch body.

Two output axial connections 21 and 22 are also provided and are suitably secured to a wall of the switch body, being shown in this particular embodiment as sandwiched between the top and bottom portions 11 and 12 of the switch body. Each of the output coaxial connections 21 and 22 have a respective central conductor indicated by reference numerals 23 and 24 which communicates with the metallic walled recess 13 formed inside the switch body.

Although the coaxial connection 18 is referred to as an input and coaxial connections 21 and 22 are referred to as outputs, obviously, the coaxial connections 21 and 22 may be considered as inputs with the coaxial connection 18 considered as an output. Throughout the description of this embodiment of the invention as well as the other embodiments specifically disclosed herein, the description of the switch will be approached from the standpoint of having one input which is selectively switched to one of a plurality of outputs. The switches disclosed herein are equally applicable to situations wherein there are a plurality of inputs, with a particular one of the inputs being selectively switched to the one output of the switch.

A switch operator 26 is provided which is a cross-shaped member including lateral side arms 26*a* and *b*, a top portion 26*c* and a bottom portion 26*d*. The switch operator is suitably pivotally mounted to the switch body by means such as a pivot post pivoted in a bed of insulating material 28 provided in a recess in the switch body. The pivot post 27 is made of an electrical conducting material and engages and makes electrical contact to the central conductor 19 of input coaxial connection 18. The switch operator 26 is provided of an insulating material and the bed of insulation 28 is necessary to prevent the pivot post 27 from coming into electrical contact with the switch body.

Recesses 28 and 29 are provided in the switch body respectively in front of the output coaxial connectors 21 and 22. Connecting pin slides 31 and 32 are respectively provided disposed in the recesses 28 and 29. Connecting pin slide 31 has a connecting pin 33 fixedly mounted thereto and connecting pin slide 32 has a connecting pin 34 fixedly mounted thereto. Connecting pin slide 31 is mechanically coupled to the lateral arm 26*a* of the switch operator by a pivot post 36 integral with the slider 31 and which is captured in a rectangular recess 37 on the lateral arm 26*a*. In a similar fashion the connecting pin slide 32 is mechanically coupled to the lateral arm 26*b* by means of a pivot post 38 carried on the connecting pin slide 32 and which is captured in a recess 39 of the lateral arm 26*b*. Connection means such as a wire 41 is provided which is soldered for example to the pivot post 27 and which makes electrical contact between the pivot post 27 and the connecting pins 33 and 34. The wire 41 may also be soldered to the connecting pins 33 and 34.

A shielding member 42 which can be made of a conductive metal, for example is mounted in front of the output coaxial connections 21 and 22 for reciprocating movement so that it covers and shields one or the other of the output coaxial connections 21 and 22. A suitable mounting arrangement for the shielding member 42 is simply a groove or recess indicated by reference numeral 43 formed in the switch body immediately in front of the output coaxial connections. The shielding member 42 is provided with an opening or aperture 44 through which the top portion 26*c* of the switch operator 26 extends.

In operation, the coaxial switch shown in FIGS. 1 through 4 is adapted to selectively make electrical contact between the central conductor of the input coaxial connection 18 and one or the other of the central conductors of the output coaxial connections 21 and 22. Thus in FIG. 3 for example the bottom portion 26*d* of switch operator 26 is positioned to the left so that the connecting pin 33 is engaged in the central conductor 23 of output coaxial connection 21. At the same time the shielding member 42 is moved by the top portion 26*c* of the switch operator 26 to a position where it is in front of and covers or shields the output coaxial connection 22. Thus crosstalk between the input coaxial connection 18 and the output coaxial connection 22 is prevented. When, on the other hand, the bottom portion 26*d* of switch operator 26 is moved to the right, the connecting pin 34 positively engages the central conductor 24 of coaxial connection 22 and the shielding member 42 is moved by the top portion 26*c* of switch operator 26 to a position in front of and shielding the coaxial connection 21.

The shielding member 42 is preferably mounted as close as possible to the output coaxial connections 21 and 22 without actually touching same for achieving the maximum isolation. With such a switch construction it has been found that a high degree of isolation is achieved for high frequency signals, without the necessity of having an inordinately complex and/or expensive switch. As an example, utilizing the switch construction shown in FIGS. 1 through 4 an isolation between the input coaxial connector and the output coaxial connector that is unused or disconnected has been achieved on the order of 85 dB or greater for signals in the frequency range of 100 MHz to 1000 MHz.

Figure 5:
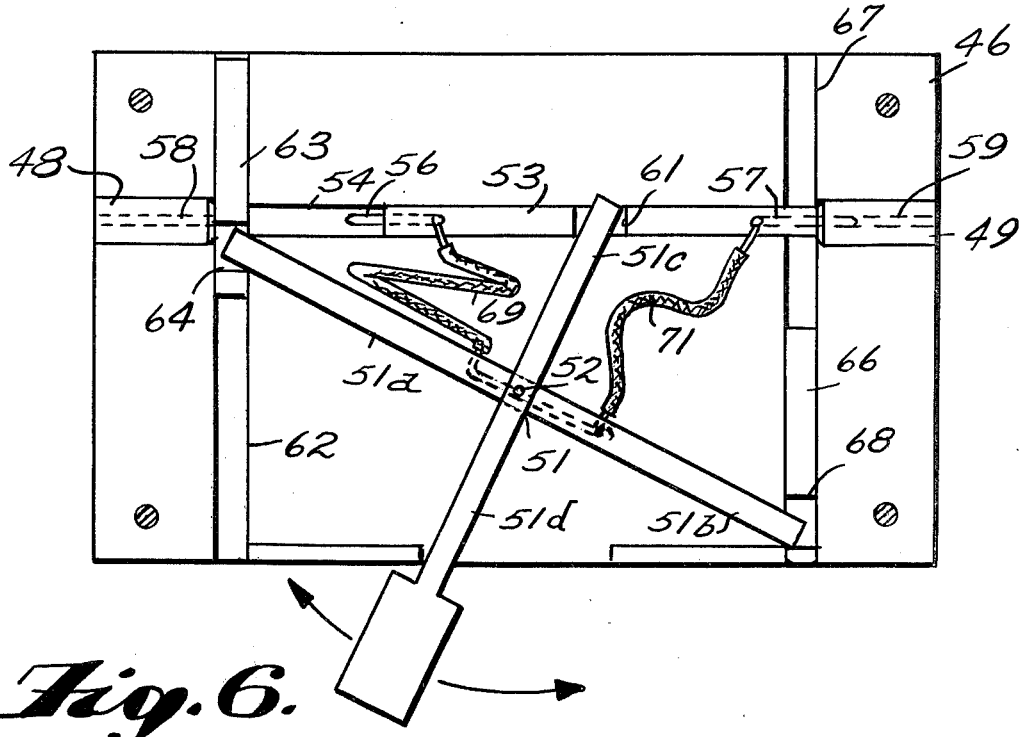
FIG. 5 is a top view of a different embodiment of a coaxial switch with a top portion of the switch body removed.
Figure 6:
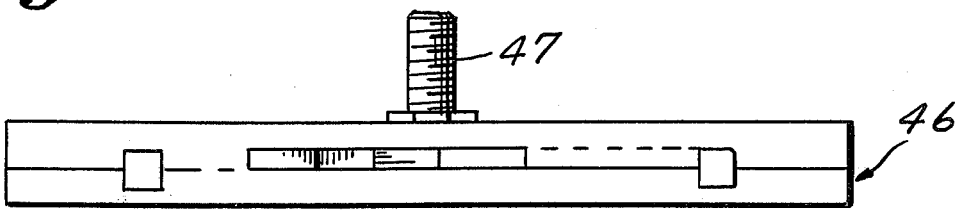
FIG. 6 is a front elevation of the coaxial switch of FIG. 5.
Figure 7:
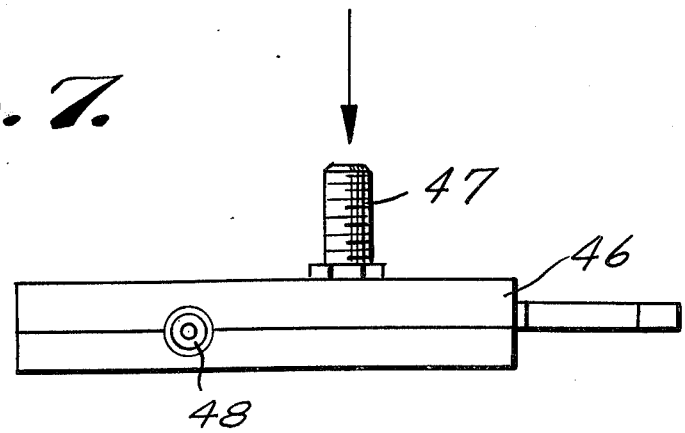
FIG. 7 is a side elevation of the coaxial switch of FIG. 5.
Figure 8:
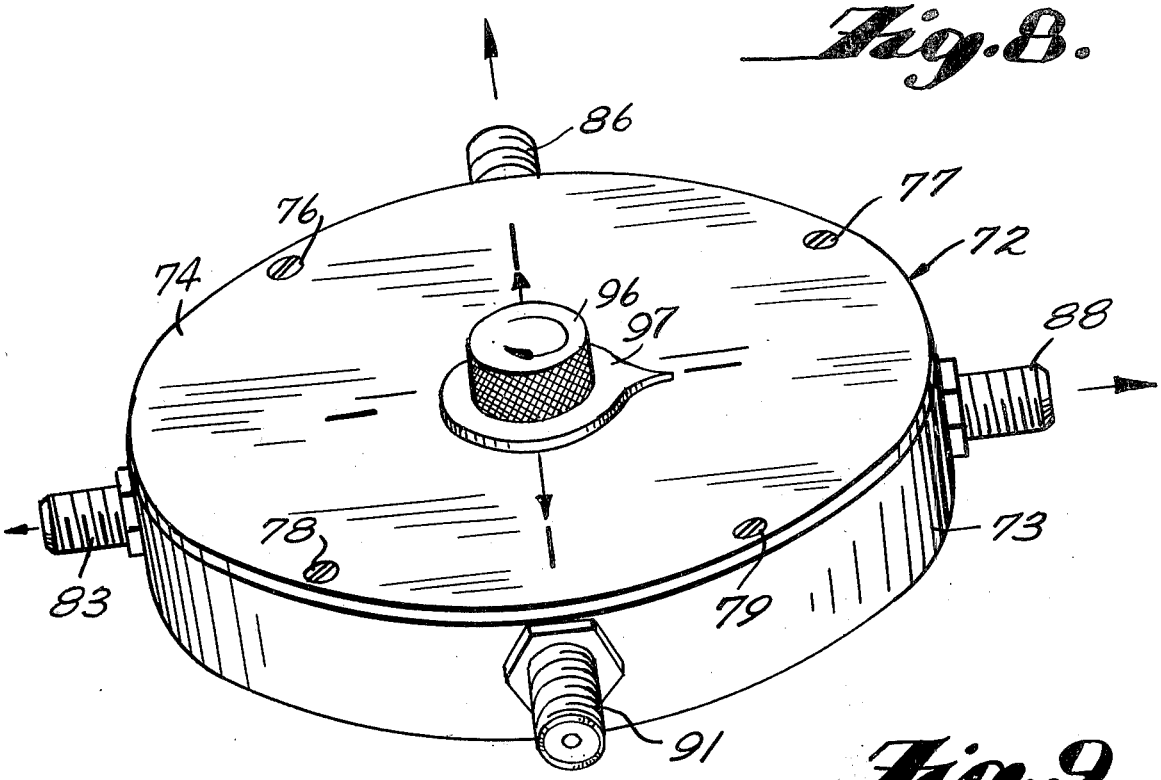
FIG. 8 is a pictorial representation of the exterior appearance of an alternate embodiment of the invention.
Figure 9:
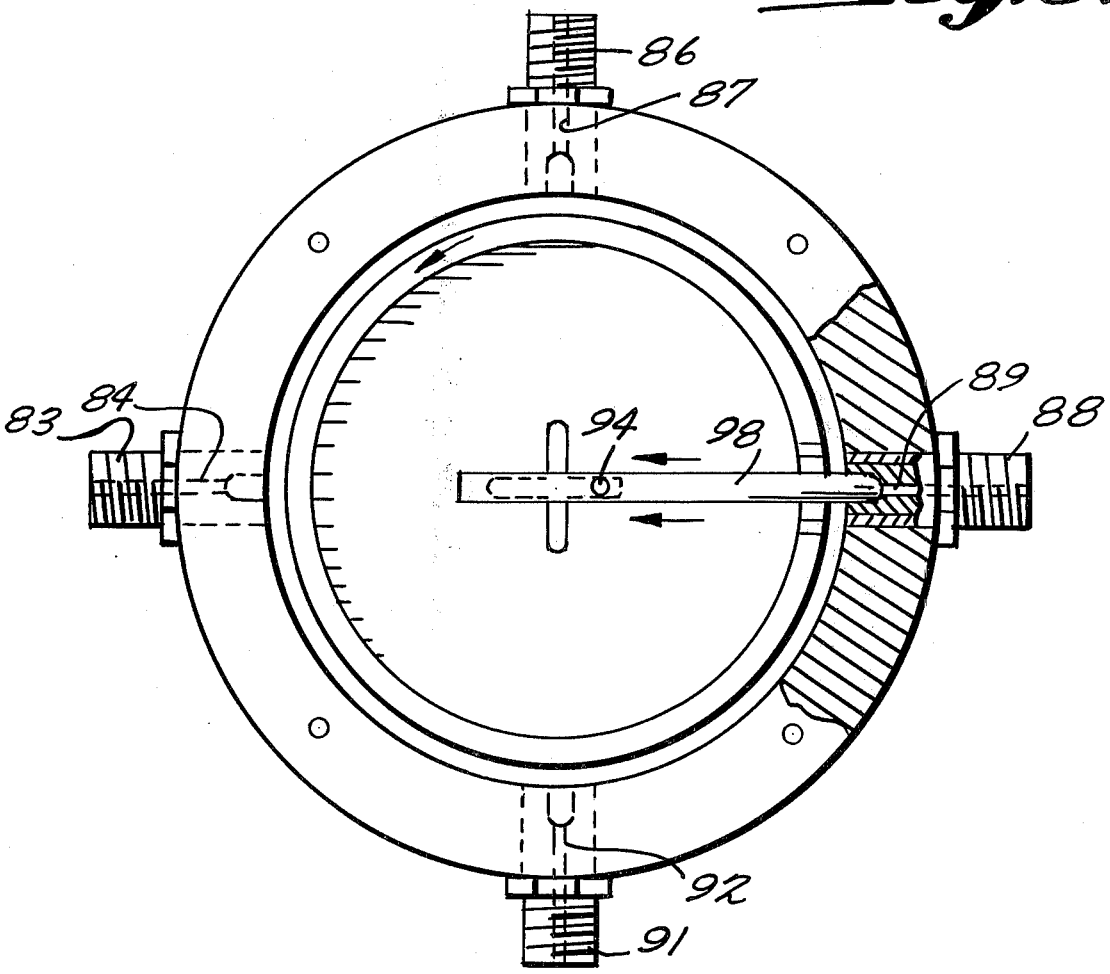
FIG. 9 is a top view of the coaxial switch of FIG. 8 with the cover removed and the switch shown partially in section.
Figure 10:
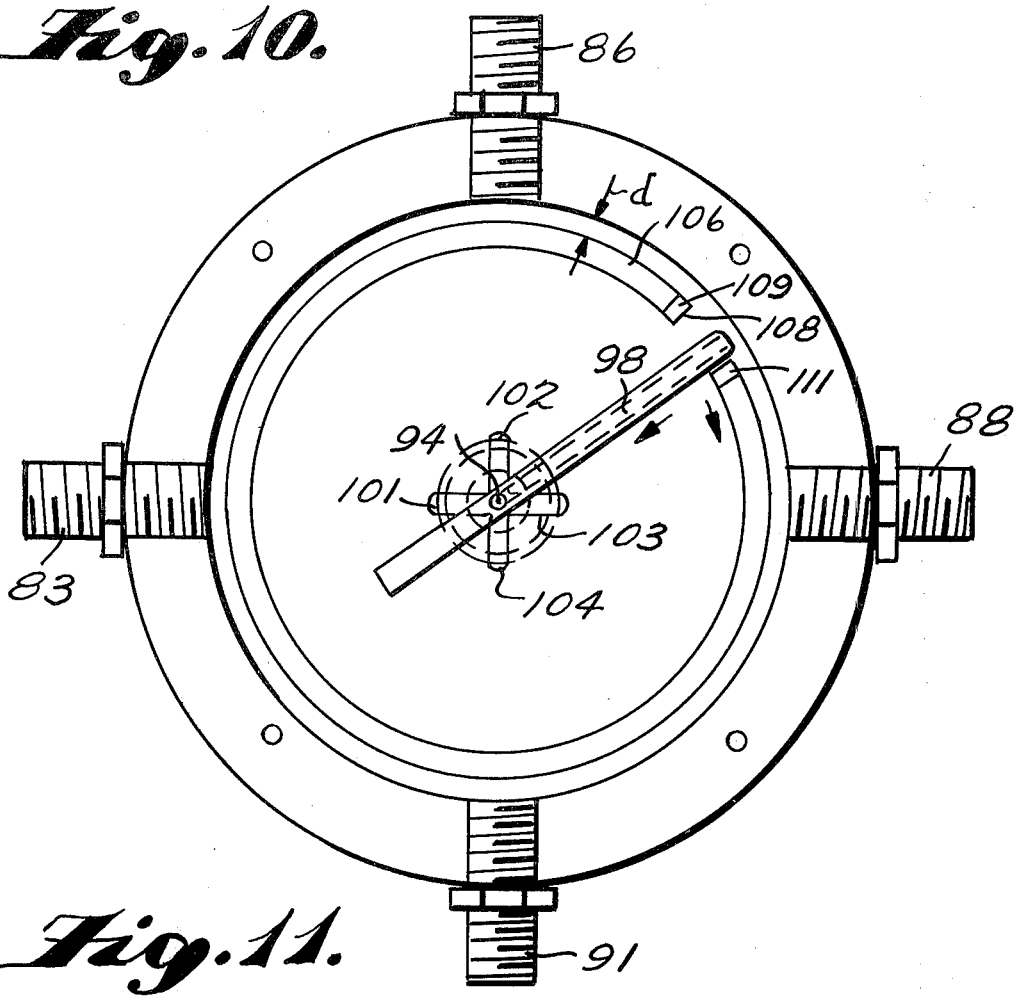
FIG. 10 is a top view somewhat similar to FIG. 9 and illustrating operation of the switch operator of the coaxial switch.
Figure 11:
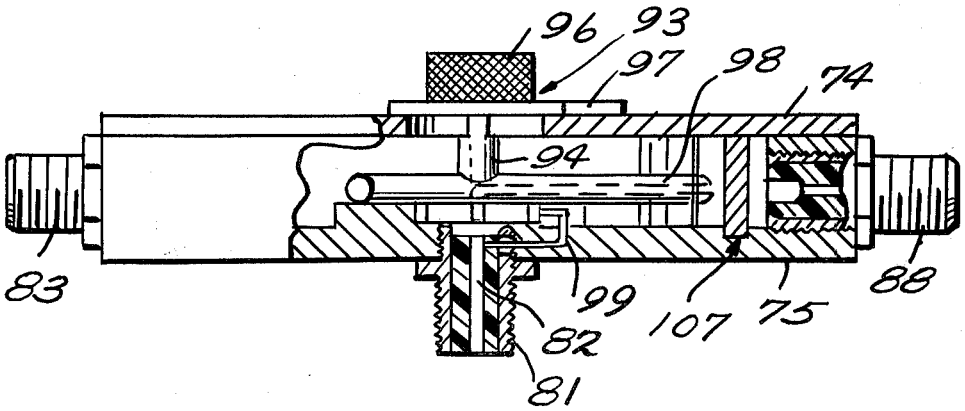
FIG. 11 is a side elevation partially in cross-section of the coaxial switch embodiment of FIG. 8.

Turning now to a consideration of FIGS. 5 through 7, there is shown an alternate embodiment of a coaxial switch in accordance with the invention. In the switch construction shown in FIGS. 5 through 7 there is provided a metallic switch body generally indicated by reference numeral 46 having a metallic walled recess therein with an input coaxial connector 47 and two output coaxial connectors 48 and 49 being provided mounted to the metallic switch body and communicating with the recess therein. A cross-shaped switch operator 51 is provided inside the recess in the switch body 46 and is suitably mounted thereto by means such as a pivot post 52 (suitably electrically insulated from the switch body 46). The pivot post 52 is made of an electrical conducting material and contacts the central conductor of input coaxial connection 47. The switch operator 51 has lateral extending arms 51*a* and 51*b* as well as a top portion 51*c* and a bottom portion 51*d*. The bottom portion 51*d* of switch operator 51 extends out of the switch body 46.

The output coaxial connections 48 and 49 are situated on opposing sides of the switch body 46 and a connecting pin slide 53 is mounted in a recess in the switch body indicated by reference numeral 54 which extends between the coaxial connections 48 and 49. The connecting pin slide 53 fixedly mounts to connecting pins 56 and 57 and is adapted for reciprocating movement along the recess 54 so that in one position the connecting pin 56 positively engages in a central conductor 58 of coaxial connection 48 and in the other position the connecting pin 57 positively engages the central conductor 59 of coaxial connection 49. The connecting pin slide 53 has an aperture or opening indicated by reference numeral 61 formed therein through which the top portion 51*c* of the switch operator 51 extends for mechanically translating movement of the top portion 51*c* into reciprocating movement of the connecting pin slide 53 along the recess 54.

A recess 62 is provided in the switch body 46 extending in front of the coaxial connection 48 along an axis generally perpendicular to the recess 54 and movement of the connecting pin slide 53. The recess 62 mounts a first shielding member 63 so that the shielding member 63 can be reciprocated along the recess 62. The first shielding member 63 has an aperture or opening indicated by reference numeral 64 into which one lateral side arm 51*a* of the switch operator 51 extends. Movement of the arm 51*a* is thus translated into reciprocating movement of the first shielding member 63.

In a similar fashion a second shielding member 66 is provided mounted in a recess 67 which extends in the switch body 46 in front of and immediately adjacent to the coaxial connection 49. The second shielding member 66 has an aperture or opening 68 therein into which the lateral side arm 51*b* of switch operator 51 extends. Movement of the lateral side arm 51*b* is thus translated into reciprocating movement of the second shielding member 66 along the recess 67 in front of the coaxial connection 49. A wire 69 is provided to electrically connect the pivot post 52 (and hence the central conductor of input coaxial connection 47) to the connecting pin 56. Similarly, electrical connection means such as a wire 71 is provided to electrically connect the pivot post 52 to the connecting pin 57.

In operation, the coaxial switch of FIGS. 5 through 7 operates in a fashion similar to that of the coaxial switch shown and described in connection with FIGS. 1 through 4. In the embodiment of FIGS. 5 through 7, movement of the bottom portion 51*d* of switch operator 51 is coupled to the connecting pin slide 53 so that one or the other of the connecting pins 56 and 57 (depending upon which direction the bottom portion 51*d* is moved) positively engages the central conductor of the associated output coaxial connection. Assuming, for example, that the switch operator is in the position shown in FIG. 5, the connecting pin 57 positively engages the central conductor 59 of coaxial connection 49 and connecting pin 56 is disengaged from the coaxial connection 48. In the position shown in FIG. 5, however, the first shielding member 63 is reciprocated by the side arm 51*a* to the position shown in FIG. 5 where it is immediately in front of and in a shielding relationship with the coaxial connection 48. This functions to shield the input signal on input coaxial connection 47 (which is also present on connecting pin 56) from the coaxial connection 48 so as to prevent crosstalk therebetween. When, on the other hand, the switch operator is moved to a position opposite that shown in FIG. 5, the connecting pin 56 engages the central conductor 58 of coaxial connection 48, connecting pin 57 is disengaged from coaxial connection 49, and the second shielding member 66 is positioned in front of and in a shielding relationship with the coaxial connection 49. Thus in this switch embodiment two shielding members are provided, which are mechanically coupled to a switch operator and which are always positioned in front of an unused output coaxial connection so as to shield the unused output coaxial connections from the input coaxial connection and prevent crosstalk therebetween.

Turning now to a consideration of FIGS. 8 through 11, there is shown still another embodiment of a coaxial switch in accordance with this invention. In accordance with this embodiment the coaxial switch includes a cylindrical metallic switch body 72 including cylindrical wall 73 and ends 74 and 75. The end 75 may be formed integrally with the wall portion 73 with the end 72 being detachably secured to the wall 73 by means such as screws 76 through 79.

An input coaxial connection 81 having a central conductor 82 is provided and is suitably mounted in an end such as end 75 of the switch body by means such as being threadably secured thereto. A plurality of output coaxial connections are provided mounted to the cylindrical wall 73 of the switch body. In the particular embodiment shown in the drawings four output coaxial connections 83, 86, 88, and 91 are provided having respective central conductors 84, 87, 89 and 91 which communicate with the metallic walled recess formed inside the switch body 72. Although in the particular embodiment of the invention described in connection with FIGS. 8 through 11 a coaxial switch is shown having four output coaxial connections, it should be obvious that the invention is equally applicable to coaxial switches having less than or greater than four such output coaxial connections.

A switch operator 93 is provided which includes a pivot post portion 94 and a control portion 96 extending exterior to the switch body 72. The control portion 96 may conveniently incorporate a pointer 97 whose function will be later described. The pivot post portion 94 of the switch operator 93 mounts a connecting pin 98 which is electrically connected by suitable means such as a wire 99 to the central conductor 82 of input coaxial connection 81. The top 74 of switch body 72 is provided with a plurality of guide recesses 101 through 104 which are aligned with the plurality of output coaxial connections 83, 86, 88 and 91.

A cylindrical shielding member 106 is provided mounted inside the switch body 72 and concentrically arranged with respect to the cylindrical wall 73 with there being provided a spacing d therebetween. The cylindrical shielding member 106 is suitably mounted for rotation inside the switch body 72 by suitable means, such as by the provision of a recess 107 in the end 75 of switch body 72.

The cylindrical shielding member 106 is continuous except for the provision of an aperture or opening generally indicated by reference numeral 108. The connecting pin 98 extends through the aperture 108 provided in the cylindrical shielding member 106. To prevent electrical contact being made between the connecting pin 98 and the shielding member 106 the aperture 108 in shielding member 106 may be provided with electrical insulating means 109 and 111. Alternatively, of course, instead of providing insulating material on the shielding member the insulation material may be instead provided on that portion of the connecting pin 98 which lies adjacent to and which would contact the shielding member.

In operation, the coaxial switch construction shown in FIGS. 8 through 11 permits selective connection of the input coaxial connector 91 to any of the output coaxial connections 83, 86, 88 and 91. The particular output coaxial connection desired is selected by rotating the control portion 96 of the switch operator 93 until the pointer 97 is aligned with whichever one of the output coaxial connections it is desired to connect. Alignment of the pointer 97 with the desired coaxial output connector corresponds to alignment of the connecting pin 98 with the central conductor of the desired output coaxial connection. Then by a sliding movement of the control portion 96, which will be guided by the appropriate one of the guide recesses 101 through 104, the connecting pin 98 makes positive engagement with the central conductor of the selected output coaxial connection, as shown for example in FIG. 9. As can be appreciated from a consideration of the FIGS. 8 through 11, rotation of the control portion 96 with consequent rotation of the connecting pin 98, also serves to rotate the shielding member 106 such that all of the output coaxial connections except the particular one selected are shielded by the shielding member 106. The configuration of the connecting pin and the shielding member 106 are such that when the connecting pin is withdrawn from engagement with an output coaxial connection it abuts the side of the aperture 108 in shielding member 106 so that subsequent rotation of the connecting pin 98 (caused by rotation of the control portion 96) will also rotate the shielding member 106. Thus the shielding member 106 is always positioned so that it covers and electrically isolates those of the output coaxial connections which are not selected for connection to the input coaxial connection.

To achieve maximum isolation between unused or unselected output coaxial connections and the input coaxial connection the distance d between the shielding member 106 and the switch body should be as small as possible. Preferably, this distance is on the order of 0.001 inches.

With the switch constructions which have been described above as particular embodiments of the invention, positive connection between an input coaxial connection and a desired output coaxial connection are easily and inexpensively achieved, with a shielding member being automatically positioned in front of all of the unused or unselected coaxial output connections so as to isolate them and prevent crosstalk. The particular embodiments of the invention have been described by using terminology of having one input coaxial connection and a plurality of output coaxial connections; obviously the terminology may be reversed so that a plurality of input coaxial connections are selectively switched to a single output coaxial connection. Further, although the invention has been described with respect to specific embodiments, it should be obvious to those skilled in this art that various modifications and substitutions to the particular embodiments disclosed herein are possible without departing from the true spirit and scope of the invention.

What I claim is:

1. A coaxial switch including a switch body having a metallic walled recess therein, an input coaxial line connection mounted to a wall of said switch body and including a central conductor communicating with said metallic walled recess, a plurality of output coaxial line connections mounted to a wall of said switch body and each including a central conductor communicating with said metallic walled recess, a switch operator including at least one connecting pin for positive engagement in a central conductor of an output coaxial line connection, electrical connection means connecting said connecting pin to the central conductor of said input coaxial line, connecting mounting means mounting said switch operator for selective movement between a plurality of positions with said at least one connecting pin engaging the central conductor for a different one of said output coaxial line connections at each of the plurality of positions, and at least one conductive shielding member separate from but operatively coupled to said switch operator and moved in accordance therewith, said shielding member moved by said switch operator to a position immediately adjacent and covering all of the central conductors of the plurality of output coaxial connections other than the one engaged by said connecting pin, wherein said switch body housing has a cylindrical configuration with said input coaxial connection disposed at an end of the cylindrical switch body housing and said output coaxial connections disposed around the wall of the cylindrical switch body housing, and wherein said shielding member is cylindrical and disposed within said cylindrical body housing for rotation therein, said cylindrical shielding member being provided with an aperture in the wall thereof, said switch operator being mounted to an end of said cylindrical body housing and having a control portion external to said housing and another portion including said connecting pin within said housing, said switch operator being mounted such that said connecting pin can be both rotated and longitudinally displaced between engaged and disengaged positions by said control portion, said connecting pin extending through the aperture in said shielding member and positively engaging the central conductor of one of the output coaxial connections when engaged, said connecting pin and said shielding member both being rotated by said control portion so that said connecting pin is always aligned with the aperture in said shielding member.

2. A coaxial switch in accordance with claim 1, wherein said connecting pin when disengaged is only partially withdrawn through the aperture whereby rotation of said connecting pin by said control portion also causes rotation of said shielding member.

3. A coaxial switch in accordance with claim 2, including electrical insulating material lining the aperture to prevent electrical contact between said shielding member and said connecting pin.

4. A coaxial switch in accordance with claim 2, including electrical insulating material provided on a portion of said connecting pin whereby when said connecting pin is disengaged said insulating material contacts the shielding member at the aperture periphery to prevent electrical contact between said shielding member and said connecting pin.

5. A coaxial switch in accordance with claim 2, wherein the cylindrical shielding member is of a size such that when mounted within said cylindrical body housing an airspace exists between the body housing wall and said shielding member of not more than 0.002 inches.

6. A coaxial switch including a switch body having a metallic walled recess therein, an input coaxial line connection mounted to a wall of said switch body and including a central conductor communicating with said metallic walled recess, a plurality of output coaxial line connections mounted to a wall of said switch body and each including a central conductor communicating with said metallic walled recess, a switch operator including at least one connecting pin for positive engagement in a central conductor of an ouput coaxial line connection, electrical connection means connecting said connecting pin to the central conductor of said input coaxial line, connecting mounting means mounting said switch operator for selective movement between a plurality of positions with said at least one connecting pin engaging the central conductor for a different one of said output coaxial line connections at each of the plurality of positions, and at least one conductive shielding member separate from but operatively coupled to said switch operator and moved in accordance therewith, said shielding member moved by said switch operator to a position immediately adjacent and covering all of the central conductors of the plurality of output coaxial connections other than the one engaged by said connecting pin, wherein two output coaxial connections are provided situated side-by-side and wherein said switch operator comprises a cross-shaped member having two lateral arms, a top portion and a bottom portion and being pivotally mounted to said housing at the intersection of its arms and top and bottom portions, the bottom portion of said switch operator extending outside the metallic walled recess to form an operating portion, the top portion of said switch operator being coupled to said shielding member, said shielding member mounted for reciprocating movement to cover one or the other of said output coaxial connections under control of said operating switch, and two connecting pins operatively coupled one to either of said switch operator lateral arms, whereby when the bottom portion of the switch operator is in one position one connecting pin positively engages the central conductor of one output coaxial connection and said shielding member covers the central conductor of the other output coaxial connection, and when the bottom portion of the switch operator is in another position the other connecting pin positively engages the central conductor of the other output coaxial connection and said shielding member covers the central conductor of the one coaxial output connection.

7. A coaxial switch in accordance with claim 6, including first and second coupling elements mounted respectively in front of the two output coaxial connections and approximately perpendicular to the plane of reciprocating movement of said shielding member, said first and second coupling elements mounting the two connecting pins respectively and being respectively pivotally fixed to the two lateral arms of said switch operator.

8. A coaxial switch including a switch body having a metallic walled recess therein, an input coaxial line connection mounted to a wall of said switch body and including a central conductor communicating with said metallic walled recess, a plurality of output coaxial line connections mounted to a wall of said switch body and each including a central conductor communicating with said metallic walled recess, a switch operator including at least one connecting pin for positive engagement in a central conductor of an output coaxial line connection, electrical connection means connecting said connecting pin to the central conductor of said input coaxial line, connecting mounting means mounting said switch operator for selective movement between a plurality of positions with said at least one connecting pin engaging the central conductor for a different one of said output coaxial line connections at each of the plurality of positions, and at least one conductive shielding member separate from but operatively coupled to said switch operator and moved in accordance therewith, said shielding member moved by said switch operator in a position immediately adjacent and covering all of the central conductors of the plurality of output coaxial connections other than the one engaged by said connecting pin, wherein two output coaxial connections are provided mounted in opposing sides of said switch body housing and wherein said switch operator comprises a cross-shaped member having two lateral arms, a top portion and a bottom portion and being pivotally mounted to said housing at the intersection of its arms and top and bottom portions, the bottom portion of said switch operator extending outside the metallic walled recess to form an operating portion, a connecting pin member mounted for reciprocating movement along an axis connecting the two output coaxial connections, said connecting pin member carrying two oppositely disposed connecting pins and being coupled to the top portion of the switch operator for being moved thereby, first and second shielding members being mounted for reciprocating movement respectively in front of the two output coaxial connections approximately perpendicular to the axis of movement of said connecting pin member, said first and second shielding members being respectively operatively coupled to the lateral arms of the switch operator for movement thereby.

* * * * *